United States Patent [19]

McKibbin et al.

[11] 4,214,671

[45] Jul. 29, 1980

[54] FLOATING ROOF DRAINAGE SYSTEM

[75] Inventors: Dean K. McKibbin, Warren; Richard E. Hills, Coraopolis; Joel Blackman; Franklin A. Kuhs, both of Pittsburgh, all of Pa.

[73] Assignee: Pittsburgh-Des Moines Steel Company, Pittsburgh, Pa.

[21] Appl. No.: 971,252

[22] Filed: Dec. 20, 1978

[51] Int. Cl.[2] ..... B65D 87/18

[52] U.S. Cl. ..... 220/219

[58] Field of Search ..... 220/219, 220, 227

[56] References Cited

U.S. PATENT DOCUMENTS

| | | | |
|---|---|---|---|
| 1,493,091 | 5/1924 | Wiggins | 220/219 X |
| 1,668,792 | 5/1928 | Wiggins | 220/219 X |
| 1,761,700 | 6/1930 | Bailey | 220/219 |
| 1,767,142 | 6/1930 | Kramer | 220/219 |
| 2,359,723 | 10/1944 | Hammeren | 220/219 |
| 2,422,322 | 6/1947 | Ulm | 220/219 |
| 2,717,095 | 9/1955 | Gable | 220/219 |

*Primary Examiner*—Steven M. Pollard

*Attorney, Agent, or Firm*—Shoemaker and Mattare, Ltd.

[57] ABSTRACT

A floating roof drainage system which includes a plurality of pipes. The pipes are weldably connected to each other to form a completely welded system, and, in one embodiment, are completely suspended from the bottom of the floating roof. In another embodiment, the drainage system is supported on the rimplate of the floating roof just beneath a seal. The pipes in one embodiment are prestressed, and the pipes in all embodiments are sequentially moved as the floating roof moves.

39 Claims, 30 Drawing Figures

FIG. 5.
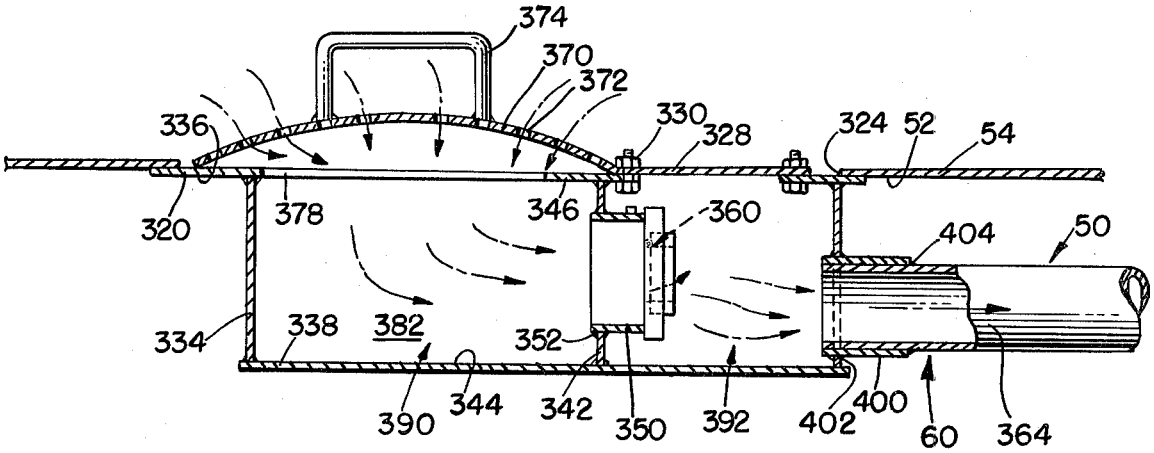
FIG. 6.
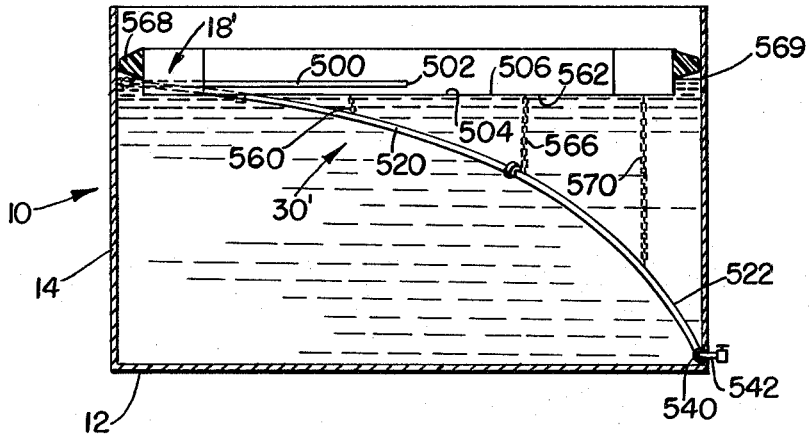
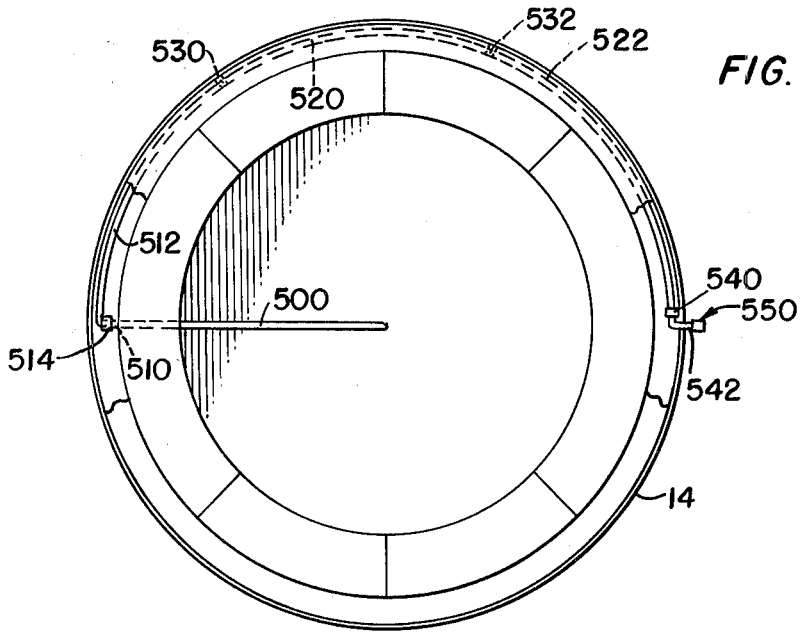
FIG. 7.

FLOATING ROOF DRAINAGE SYSTEM

BACKGROUND OF THE INVENTION

The present invention relates in general to floating roof tanks, and, more particularly, to drainage systems for such floating roof tanks.

In floating roof tanks, that is those tanks having no fixed roof, any water which collects on the roof, for example through precipitation falling on the roof, should not be drained into the product stored in the tank. Therefore, drainage systems for floating roofs generally include some type of drain line, such as a pipe or a hose, fluidly connecting a drain point on the floating roof to a drain point outside the tank, with such drain line passing through a wall of the tank. In such a system, the water from the roof usually enters the drain line via a sump located at the center of the floating roof, then drains through the line and exits the tank through a valve located near the bottom of the tank wall.

Historically, these drain lines are subject to many drawbacks. For example, because the drain line passes through the stored product, and as spillage of the product is undesirable, the drain valve to which the drain line is connected is usually kept closed. Thus, water is allowed to accumulate on the floating roof until an operator decides that the roof should be drained. The valve is then manually opened to drain the water from the floating roof. However, if a rupture in the drain line occurs while the manual valve is open, product may escape from the tank via the drain valve. Such product escape is highly undesirable as, not only is valuable product lost, but safety hazards are created.

Floating roof drainage systems have heretofore been of two basic designs. The first design includes a hose drain, and in this design, a hose is attached to a sump on the floating roof, runs through the product, and is then attached to a penetration in the tank wall just upstream of the drain valve. This hose must be weighted because it is normally dry and self-buoyant. Such hoses are generally made of reinforced rubber-like materials, and are subject to machanical and chemical abuse from the operation of the tank and/or from the product stored in the tank.

A second design has included pipes interconnected by swing joints. The concept of this second design is to provide a conduit which is more resistant to mechanical and/or chemical abuse than are the hoses in the first design. However, the swing joint design also has weaknesses, and the primary weakness of the swing joint design appears in the joints and seals used in those joints. These swing joint designs often leak product into the drainage system.

When weighted, the hose rests on the tank bottom. In this position the hose can be frozen into any water that collects below the product in the tank. Subsequently, upward movements of the floating roof can damage the hose. Also, the hose cannot drain completely dry since the hose on the tank bottom is lower than the attachment thereof to the drain penetration on the tank shell. This trapped water can freeze with resultant damage to the hose.

Other drawbacks to heretofore known drainage systems include buoyance induced looping of the hoses, and tangling, kinking and crushing of the hoses if the hoses float freely in the tank.

The inventor is also aware of drainage systems which include articulated drain pipes. An example of such articulate systems is disclosed in U.S. Pat. No. 2,717,095 issued to M. W. Gable. In the Gable patent, a plurality of rigid drain pipes are connected together by compound joints which each has a structural hinge and an independent flexible liquid connection. However, the joints in this drainage system are still subject to failure and suffer drawbacks similar to those already discussed.

The inventor is also aware of a drainage system which includes a loop of steel pipes interconnected by bolted flange-type joints at the bends in the loop. The bolted connections in this system do not flex one relative to the other, but remain fixed. As the floating roof moves, a complicated system of cables picks up the loop and extends the dimensions of that loop in a vertical direction. Such an extension stresses the pipe loop, and this stressing is minimized by prestressing the loop as it is installed. As the tank is worked and the floating roof moves, the prestress is reduced to zero, and eventually the stress level becomes the negative of the prestress level.

This last-mentioned drainage system is subject to several drawbacks, however. The major drawback arises because of the need for gasketing between the flanges of the bolted joints of the system. Such bolted connections are subject to leaks, and any gasketing is thus subject to chemical attack by the stored product. Furthermore, the loop in this design is nearly constantly stressed throughout the entire length thereof. Thus, this design includes a system of pulleys and cables to pick up the entire loop when the floating roof is moved. These pulleys and cables are attached to the loop at a midpoint on that loop, and this point moves half travel as the floating roof moves. As the floating roof moves from the tank empty to the tank full position, this attachment point moves half that vertical distance. This design requires housings to protect the cable and pulley mechanism, and may not be usable in cold climates. The present invention replaces this system of cables and pulleys attached at one midpoint by a system of chains or the like attached at several locations along the length of the loop.

The inventor is also aware of the following patents which disclose drainage systems for floating roofs:

U.S. Pat. No. 2,315,023
U.S. Pat. No. 2,657,821
U.S. Pat. No. 2,482,468
German Pat. No. 236,427—1911

SUMMARY OF THE INVENTION

The drainage system embodying the teachings of the present invention comprises a plurality of pipes coupled together by joints which are welded and is supported from beneath the floating roof. Portions of the system are moved sequentially as the roof moves. Thus, there is no need for a complicated system of cables and pulleys and only appropriate portions of the drainage system are picked up by connectors such as chains, or the like. The sequential moving of the pipes in the drainage system of the present invention produces several advantages over those systems embodying the teachings of the prior art. Another embodiment of the present system includes pipes which are prestressed according to the stresses that will occur in those pipes rather than prestressing the entire system as a whole.

In one embodiment, the drainage system incorporates a plurality of straight and bent segments of pipe in the form of a square or rectangle with rounded corners.

One end of the pipe system is connected to a sump at the roof, the other end exits the tank shell near the bottom.

The rounded corners have chain or cable or predetermined length attached and connected to the underside of the floating roof. The chains will cause the drain pipe system to progressively unfold as the floating roof is raised from empty to full position by the filling of the tank with product. The unfolding action of the piping system compensates for the change in height of the roof.

The forces imposed on the piping system by the unfolding action are reacted by bending and torsional resistance within the pipe. The chain or cable suspension limits the unfolding action thus limiting the resulting stress to a level that is not detrimental to the piping system.

The installation of this embodiment of the drainage system is simplified by eliminating the need for presetting the pipe connections. This pipe arrangement allows assembling the pipe on the bottom supports in a simple operation. The completed assembly will thus be in an unstressed condition (except for dead load which may cause minor sagging over the supports). As the filling operation occurs the unfolding of the pipe will cause stress in the pipe to be in one direction, thus no stress reversal will occur as the pipe loop moves from the tank-empty to the tank-full positions. This is desirable from a fatigue standpoint.

Additional features of this embodiment are: (a) deflection limitation devices such as chains, rods, cables or other support means are provided to distribute operating deflections in accordance with the design basis; (b) no initial preset of geometry is required for limitation of operating stresses.

It is intended that materials of construction will be metallic or other compatible material in regard to the product being stored.

The drainage system of the present invention is moved without the need for pulleys and the like. The cost of the presently disclosed system is therefore reduced from those systems using such elements. The cost of the elements themselves is eliminated, the cost associated with providing penetrations of the roof for those elements is eliminated, and the like. Furthermore, as the roof penetrations may be sources of evaporation loss through the floating roof and may be points through which leakage of product onto the roof can occur, elimination of such penetrations eliminates such potential problem areas. Still further, as the system is supported in a manner which does not cause penetration of the roof, the above-discussed advantages are even further enhanced.

All of the joint connections of the pipes in the presently disclosed drainage system are welded, thereby producing a completely welded system from sump to drain, and a leaktight system is thus produced. Accordingly, there is no problem of chemical compatibility of the joints with the product, or with leaks at the connections. Once a leaktight weld is formed, such problems are eliminated.

As compared with swing joint systems, there are no moving parts in the presently disclosed drainage system, thus wear is minimized and hence the possibility of leaks is further reduced.

Unlike a rubber hose system, this drainage system is welded into a complete pipe coil. The horizontal projection remains constant and hence the possibility of roof legs damaging the system when the floating roof lands is eliminated.

There are no flanged joints in the present system, i.e., it is entirely welded from tank shell to roof sump, and hence the above-discussed advantages result.

There are no cables or balancing counterweights located above the floating roof deck, and thus, the costs and drawbacks of such elements are eliminated.

As the pipes in the prestressed embodiment in the drainage system coil are stressed from a prestressed torque to zero to a final torque value in sequence rather than having such stressing of the entire coil, complicated and expensive supporting systems are not needed in the presently disclosed system.

OBJECTS OF THE INVENTION

It is, therefore, a main object of the present invention to provide a drainage system for a floating roof which is completely welded from roof located collection point to drain.

It is another object of the present invention to provide a drainage system for a floating roof which is supported from beneath the floating roof.

It is a further object of the present invention to provide a drainage system for a floating roof which has a plurality of pipes with individual pipes sequentially moved during movement of the floating roof.

It is yet a further object of the present invention to provide a drainage system for a floating roof which has a plurality of pipes which are not prestressed.

It is still another object of the present invention to provide a drainage system for a floating roof which is solidly attached to the floating roof and to the tank and which includes a plurality of straight lengths of pipe joined to curved elbows to form a rectangular or square configuration.

It is still a further object of the present invention to provide a drainage system for a floating roof which will accommodate vertical roof movements through a range of travel of that roof with induced forces being handled by combined bending and torsion.

It is yet another object of the present invention to provide a drainage system for a floating roof which has a plurality of pipes with the individual pipes sequentially stressed during movement of the floating roof.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 5 is a view taken along line 5—5 of FIG. 4.

FIG. 6 is an elevation view of an alternative embodiment of the drainage system embodying the teachings of the present invention.

FIG. 7 is a plan view of the drainage system shown in FIG. 6.

DETAILED DESCRIPTION OF THE INVENTION

Figure 1:
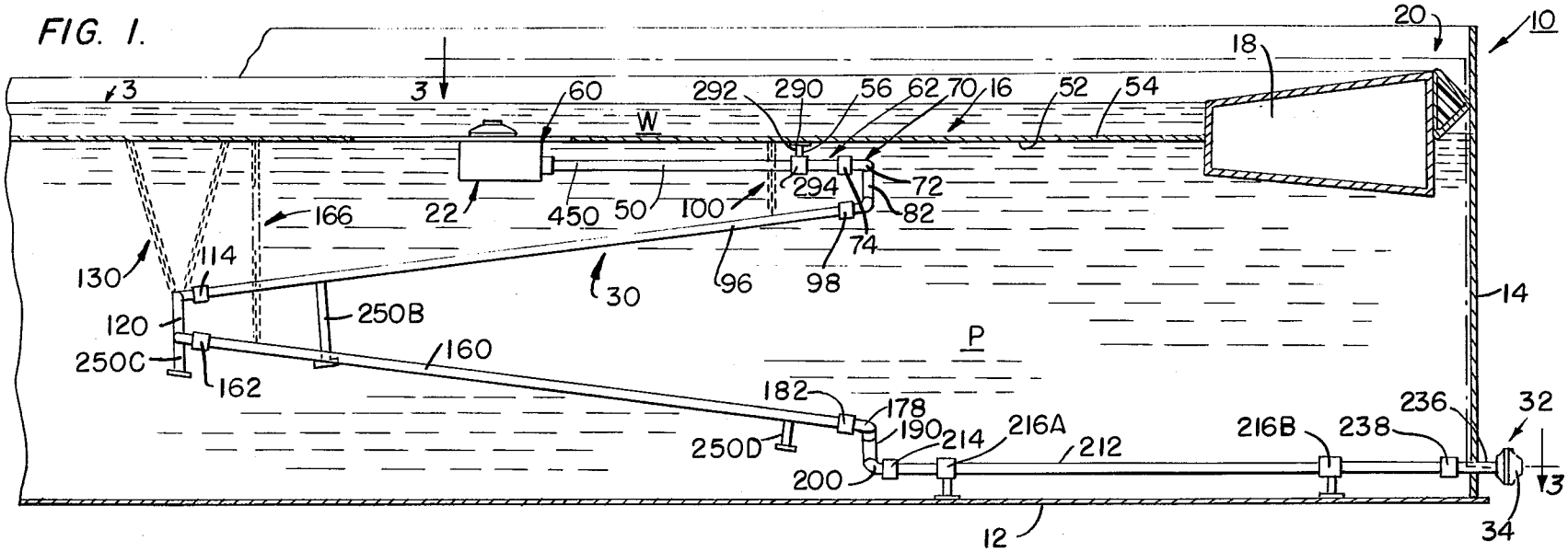
FIG. 1 is an elevation view of a tank and floating roof incorporating a drainage system embodying the teachings of the present invention in a deployed configuration.

Shown in FIG. 1 is a cylindrical tank 10 having a bottom 12 and walls 14. A floating roof 16 having a pontoon 18 and a seal 20 is located to be freely movable in the tank as the level of product P changes. Water W may be located on top of the roof. The floating roof has a drainage system which includes a collection means, such as sump 22, located at or near the center of the roof for draining off water which collects on the floating roof and which water may be detrimental to the system.

The floating roof in FIG. 1 has connected thereto one embodiment of the presently disclosed drainage system, and that drainage system is denoted by the reference numeral 30, and conducts water from sump 22 to outlet means 32 located at or near the tank bottom 12 and which includes a drain valve 34 which drains into a suitable collection or dike area adjacent the tank shell.

As above-discussed, the drainage system 30 accommodates movement of the floating roof. The drainage system includes a plurality of interconnected pipe sections and is suspended from the floating roof so that the pipe sections are sequentially raised and/or lowered as the floating roof moves upwardly and/or downwardly within the tank.

Figure 2:
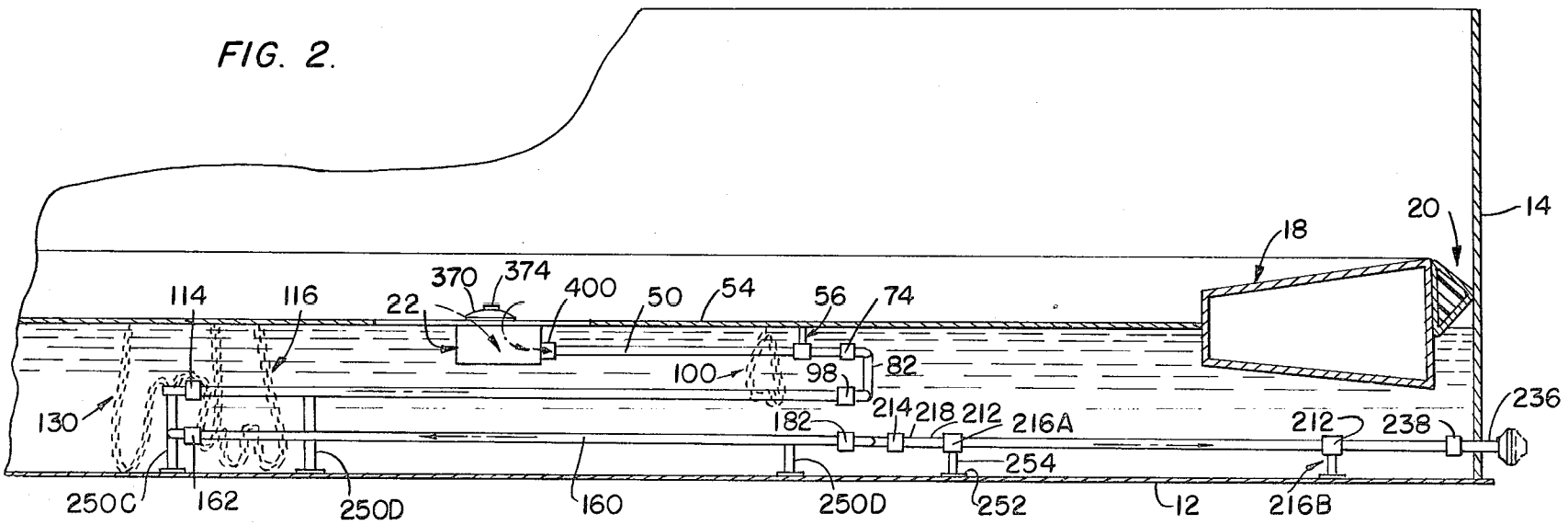
FIG. 2 is an elevation view of a tank and floating roof incorporating a drainage system embodying the teachings of the present invention in a folded configuration.
Figure 3:
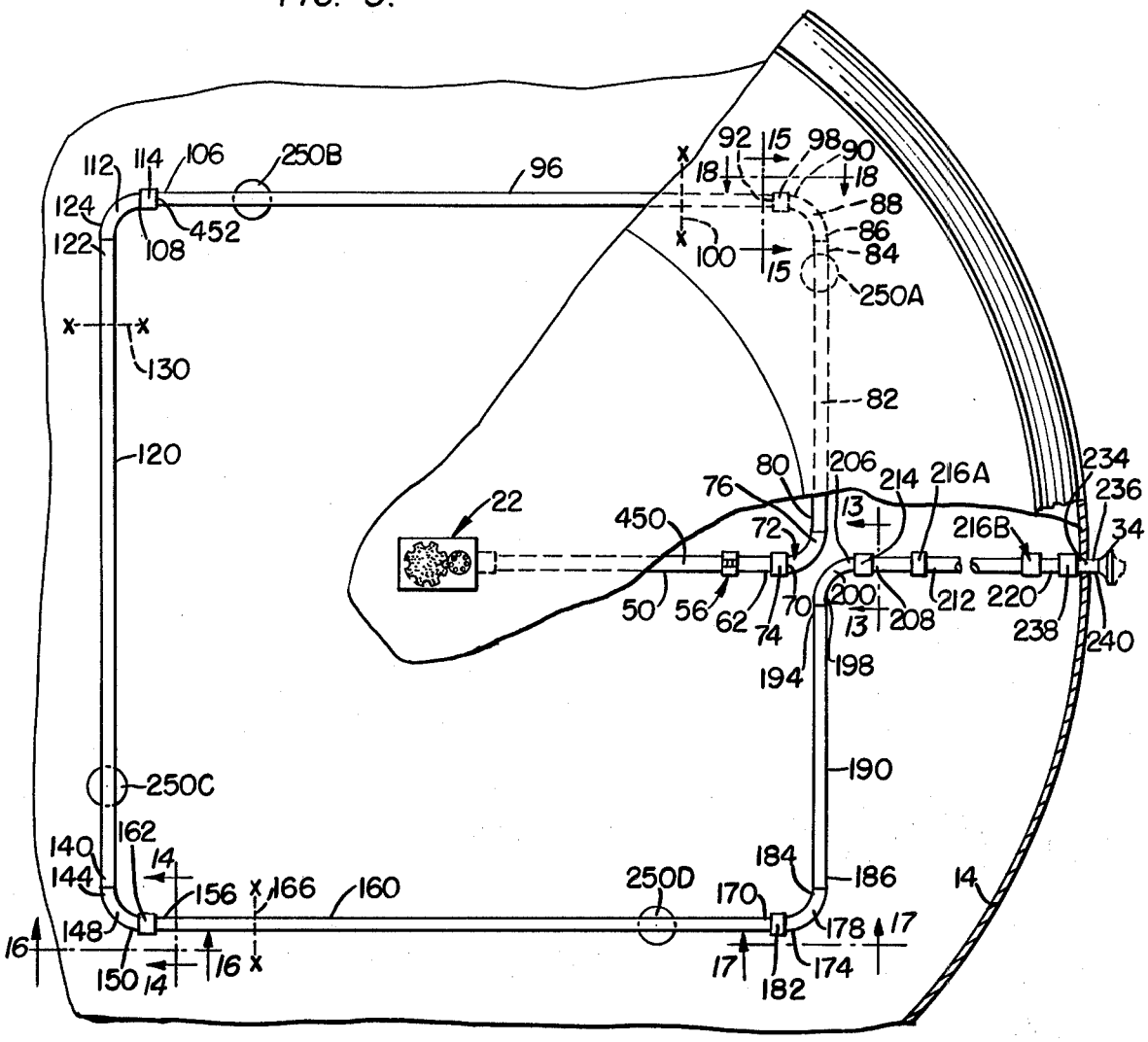
FIG. 3 is a plan view of the FIG. 1 drainage system taken along line 3—3 of FIG. 1.

As shown in FIGS. 1, 2 and 3, the drainage system includes a first horizontal pipe 50 suspended from undersurface 52 of the floating roof deck 54 by a hanger support 56 which holds the pipe vertically and horizontally but allows that pipe to torque. The pipe 50 is attached to the sump 22 at end 60 of the pipe which, for the sake of convenience, will be defined as the proximal end of the pipe, and the other end 62 of the pipe 50 is attached to an end 70 of a first welded ell 72 by a welded sleeve coupling 74. It is noted that all of the couplings disclosed herein are welded sleeve-type couplings. These couplings will be discussed in greater detail below. Again, for the sake of convenience, the end 62 of pipe 50 will be defined as the distal end thereof, and the end 70 of the ell 72 will be defined as the proximal end of that pipe. The distal-proximal identification will be continued, with the term "proximal" referring to that end or portion of an element being that end or portion situated nearest the point of connection of that element to the floating roof, and the term "distal" referring to the opposite end or portion of that element.

The ell 72 is preferably a 90° element and curves so that the proximal end 70 thereof is radially directed with respect to the cylindrical tank 10, and the distal end 76 thereof is chordally directed of the cylindrical tank. The ell 72 is downwardly tiltable with respect to the floating roof and the end 76 thereof is connected, as by welding, to end 80 of a first chordally inclinable pipe 82. Distal end 84 of the pipe 82 is connected, as by welding, to end 86 of a second welded ell 88, which is similar to ell 70 and has the distal end 90 thereof connected to end 92 of a second chordally inclinable pipe section 96 by a second welded sleeve 98. The second inclinable pipe 96 is suspended from the floating roof undersurface by a first chain connector 100 located near the proximal end of the pipe 96.

The pipe 96 has a distal end 106 thereof connected to a proximal end 108 of a third welded ell 112 by a third weld sleeve coupling 114. The ell 112 is similar to the other ells in the system, in that it is preferably a 90° element which is inclinable with respect to the horizontal to continue the inclining nature of an uncoiled drainage system.

A third chordally inclinable pipe 120 has the proximal end 122 thereof connected, as by welding, to the distal end 124 of the ell 112 and is suspended from the floating roof by a second chain connector 130 which is located near the proximal end of the pipe 120 as shown in FIG. 3.

The pipe 120 has the distal end 140 thereof connected, as by welding, to the proximal end 144 of a fourth welded ell 148 which is inclinable and curved in a manner similar to the other welded ells, and has the distal end 150 thereof connected to the proximal end 156 of a fourth chordally inclinable pipe 160 by a fourth welded sleeve coupling 162. A third chain connector 166 suspends the pipe 160 from the floating roof.

The pipe 160 is connected at the distal end 170 thereof to the proximal end 174 of a fifth welded ell 178 by a fifth welded sleeve coupling 182. The welded ell 178 is similar to the other welded ells and thus negotiates a 90° turn and is inclinable with respect to the floating roof. The ell 178 is connected as by welding at the distal end 184 thereof to proximal end 186 of a fifth chordally inclinable pipe 190. The pipe 190 is aligned with first inclinable pipe 82 and is connected at the distal end 194 thereof, as by welding, to proximal end 198 of a sixth welded ell 200.

The welded ell 200 is similar to the other welded ells and thus is tiltable and negotiates a 90° turn to have the distal end 206 thereof connected to proximal end 208 of second radial pipe 212 by a sixth welded sleeve coupling 214. The second radial pipe 212 is aligned with first radial pipe 50 and is horizontally positioned to extend toward the tank wall 14. The distal end 220 of the pipe 212 is connected to the proximal end 234 of a nozzle 236 by a seventh welded sleeve coupling 238. The nozzle 236 is welded into a tank shell and is aligned with the other radially extending pipes and extends through tank wall 14 and is connected at the distal end 240 thereof to the drain valve 34.

Drainage system 30 also includes a plurality of pipe supports 250A–250D attached to the pipes for supporting those pipes on the tank floor 12 in the folded position shown in FIG. 2 for the drainage system. The supports 250A–250D are simply small stands welded directly to the pipe for movement therewith to support and maintain a proper slope when the floating roof is in the low position. In the preferred embodiment, each support includes a 6 inch diameter base plate and an upstanding leg formed by a 2 inch pipe column which is attached to a corresponding one of the pipes. In contrast, bearing type supports 56 and 216A and 216B are fixed solidly to the underside of the roof and to the tank bottom plate. These latter supports prevent a horizontal or vertical movement, but permit a rotation. All supports 56, 216A and 216B have the same bearing components shown in FIG. 10. The bearing sleeve 256 of the bearing 216A is the wear portion of the bearing attached solidly to either the roof or the bottom. Two of these bearings are preferred and indicated by the numerals 216A and 216B, but depending on the tank size, one may be sufificient or several for large diameter tanks. Thus, bearings 216A and 216B are similar to bearing 56 in that the pipe is supported vertically and horizontally but allowed to torque. The pipe is thus anchored, but allowed to rotate by bearings 216A and 216B which are anchored to the tank or roof and do not, themselves, move. It is noted that support 250A is not shown in FIGS. 1 and 2 for the sake of clarity.

Figure 10:
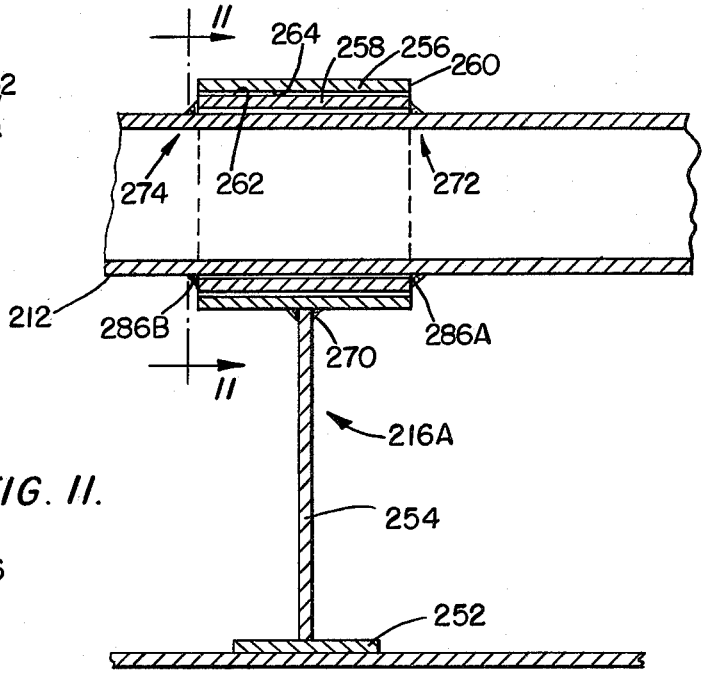
FIG. 10 is an elevation section view of a bearing and pipe support used in the drainage system embodying the teachings of the present invention.
Figure 11:
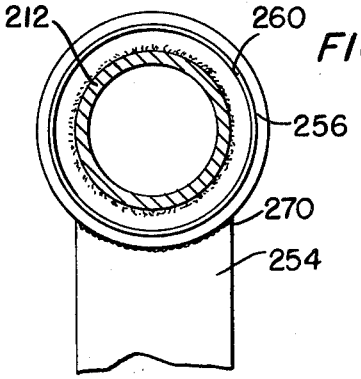
FIG. 11 is a view taken along line 11—11 of FIG. 10.

As shown in FIGS. 1, 2, 3, 10 and 11, the bearing 216A includes a sleeve 256 which encircles a wear sleeve or wear part 258 which is solidly attached to the pipe, bearings 56 and 216B each having a sleeve which encircles a pipe, and the other supports 250A–250D, inclusively, are attached directly to a pipe in a manner which does not permit those pipes to swivel with respect to the support. The bearing 216A is best shown in FIGS. 10 and 11 and the wear part 258 thereof is bored on the inner surface thereof to fit over pipe 212 which is continuous through the bearing from the left to the right side of this figure. The wear part 258 is machined on the outer surface thereof to fit inside sleeve 256. The sleeve 256 is bored on the inner surface thereof to fit around the wear part 258, and both are sized so that an annular gap 260 is defined between the outside surface 262 of the wear part and the inside surface 264 of the sleeve. The gap permits the pipe to swivel within the sleeve so that the pipes can turn in a manner which will be discussed below. The facing mating surfaces of the wear part and the sleeve allow the pipe 212 to rotate in the bearing. The wear part 258 is welded on at least one of the ends thereof to the pipe 212. As is shown in FIG. 10, welds, such as welds 286A and 286B, attach the pipe to the wear part 258. Each wear part is welded to the pipes in a similar manner. It is again noted that the pipes are continuous through the bearings. The bearing which is located in the first horizontal radial pipe 50 is similar to that shown in FIG. 10.

Thus, the drainage system 30 has a plurality of fixed supports that act as bearings for the radial pipes 50 and 212. These support bearings permit the pipe to rotate but restrain that pipe horizontally and vertically. As shown in FIGS. 1, 2, 3 and 10, the support bearings include a base attached to the undersurface of the floating roof in a non-penetrating manner such as by welding or the like. The support can also include a base attached to the tank bottom. The support and bearing are best shown in FIGS. 10 and 11. A leg 254 is welded to the base 252 and has welded by weld 270 thereto a sleeve 256. The sleeve 256 encircles a second sleeve 258 called a wear sleeve. The wear sleeve 258, in turn, is mounted around the pipe 212 and is welded directly to the pipe by welds.

The hanger 56 is similar to the bearings 216A and 216B and thus includes a base 290 attached to the undersurface 52 of the floating roof in a non-penetrating manner, such as by welding, or the like, and a leg 292 welded to the base and having welded thereto a sleeve 256 which is thereby attached to the base. The sleeve 256 encircles a second sleeve 258 called a wear sleeve. The wear sleeve 258, in turn, is mounted around the pipe 50 and is welded directly to the pipe by welds 286A and 286B.

Figure 17:
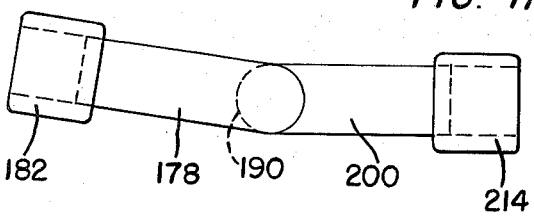
Figure 15:
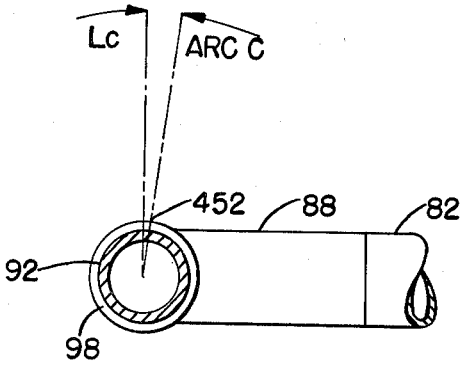
Figure 16:
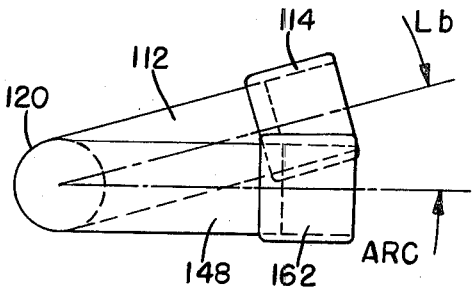
Figure 18:
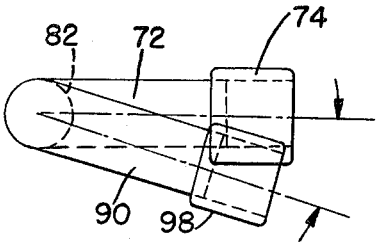

It is noted that couplings 74, 98, 114, 162, 182, 214 and 238 are made by taking a regular threaded pipe coupling and machining the inside so as to remove the threads. The coupling is shop welded to the shop assembly as shown in FIGS. 17, 16 and 18, respectively. In the field, the plain ends of pipes 50, 96, 160 and 212 are inserted into these couplings and welded to make the completed system formed to prevent leaking of the product into the drainage system, or of water into the product. This leaktightness cannot be duplicated in systems utilizing elements which inclue gaskets or the like. The welded nature of the pipe couplings allows the pipes to be joined without requiring seals and thus produces the aforementioned advantages. Such welding produces a system which is completely welded from the water collection point, such as sump 22, to drain 34, and thus a leaktight system is provided.

It is also noted that the height of the bearing and hanger legs and pipe supports can be adjusted to allow for positive drainage even when the roof in in a low position.

Figure 9:
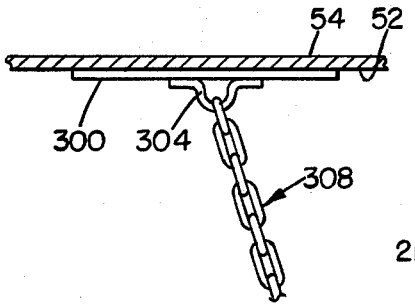
FIG. 9 is an elevation view of a connection of a chain connector to the bottom of a floating roof.

The chain connectors are all similar, and are best shown in FIGS. 1, 2 and 9 to include a mounting plate 300 fixedly mounted on undersurface 52 of the floating roof deck 54 and having a cleat 304 fixedly mounted thereon. The mounting plate is mounted on the roof in a non-penetrating manner, such as welding, or the like, and therefore produces the aforediscussed advantages. A chain, such as coil chain 308, is linked to the cleat and, as best shown in FIGS. 1 and 2, each chain connector includes a pair of downwardly converging chains which are each attached at the lower end thereof to the corresponding pipe. The chains are arranged in a triangular form and preferably, the angle of each chain at the cleat with respect to normal is about 15°, thereby defining an apex section of 30° at the pipe when the pipe is supported by the chain connector. The chains can be connected directly to the pipes, or to the pipes via collars which are attached to the pipes, as suitable.

As shown in FIG. 1, the chains of each chain connector are of equal length with each other, but the chain connectors are of different lengths. Thus, the chain connector 100 is the shortest of the three chain connectors, and the chain connector 166 is the longest, with the chain connector 130 being of a length greater than the connector 100 but less than the connector 166. The purpose of the varying lengths will be discussed below.

Figure 4:
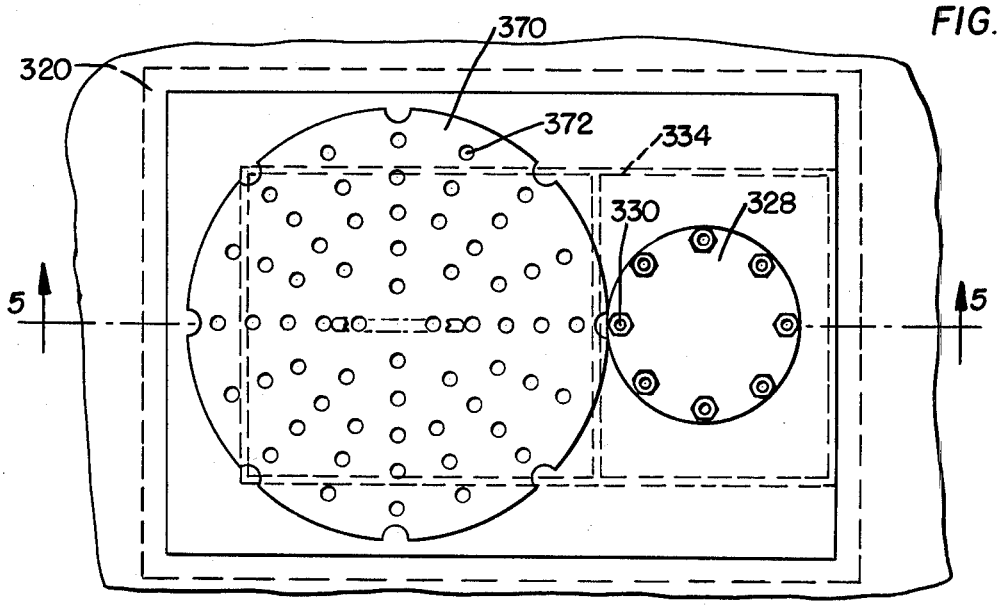
FIG. 4 is a plan view of a sump used in the drainage system embodying the teachings of the present invention.

Sump 22 is best shown in FIGS. 4 and 5, and includes a seating plate 320 connected, as by welds 324, to the undersurface 52 of the deck 54. A cover plate 328 is attached to the seating plate by fasteners, such as bolts 330. Walls 334 are dependently attached to undersurface 336 of the seating plate, and bottom 338 is attached to the walls 334. An annular partition 342 is attached to top surface 344 of the bottom 338 and the bottom surface 336 of top 320 and walls 334 as by welding. A sleeve 350 is mounted, as by welds 352, in the annular opening of the plate 342, and extends outwardly therefrom. A one-way check valve 360 is mounted in the sleeve and permits the flow of water to be established therethrough in the direction of arrows 364 only. The valve 360 is shown to be a gate valve in FIG. 5, but other one-way valves can also be used without departing from the teachings of the present invention. An access cover 370 having a multiplicity of holes 372 defined therein and a handle 374 mounted thereon is mounted on the plate 320 to cover opening 378 defined in the sump. The bottom 338, walls 334, seating plate 320 and cover 328 define a sump chamber 382 and the partition 342 divides that chamber into an upstream chamber 390 and a downstream chamber 392.

A sleeve 400 is mounted in wall 334 and extends outwardly of the chamber. The sleeve is attached to wall 334 by welds 402, or the like, and the proximal end 60 of the pipe 50 is received within the sleeve and fixed thereto by welds 404.

Referring to FIGS. 1 and 2, the operation of the drainage system will now be discussed. As the floating roof moves from the FIG. 1 position to the FIG. 2 position during emptying of the tank, the drainage system moves from the FIG. 1 unfolded configuration to the FIG. 2 folded configuration. As seen from these figures, the radial pipe 212 remains fixed relative to the bottom, and radial pipe 50 remains fixed relative to the roof and both remain substantially horizontally disposed. Thus, as the roof moves downwardly toward the tank bottom, the ells and chordally inclinable pipes move from the FIG. 1 inclined orientation into the FIG. 2 horizontal orientation. As the roof moves downwardly, the pipe sections sequentially contact the bottom via the supports 250. Thus, as seen in FIGS. 1 and 2, the pipe 190 and 160 settles onto the tank bottom, distal end first, that is bearing 250D contacts the tank bottom before the proximal end 156 reaches a horizontal orientation. The chordal pipes thus sequentially move from the FIG. 1 inclined orientation into the FIG. 2 folded configuration, distal end first, with pipes 120, 96 and 82 following in order. It is seen that the lengths of the chain connectors 166, 130 and 100 have been adjusted and selected to produce the sequential "folding" of the drainage system.

By comparing FIGS. 1 and 2 with FIG. 3, it will be seen that the pipes of the system 30 will undergo a twisting movement about the longitudinal axes thereof. Thus, for example, pipe 50 has longitudinal centerline 450, and as the roof moves downwardly, and the inclinable sections move upwardly with respect to the roof, the pipe 50 will be turned about the longitudinal axis in a counterclockwise direction. As the pipe 50 is fixed at the proximal end thereof, the turning thereof will induce a twisting of the pipe 50 about the longitudinal axis 450. Similar twisting occurs in all of the other pipes as well, and the reverse, or clockwise, twisting will occur in the pipes as the roof moves upwardly. Punch marks 452 are defined on each end of each pipe so that this twisting is identifiable. The punch marks are also shown in FIGS. 13–16, and are used so that, during field assembly, a workman can determine the proper angle necessary to torque the pipe when it is in the fully down position, as will be discussed below.

Due to the fixed nature of the welded couplings, the twisting of the pipes induces shear forces in the pipes. To compensate for this twist-induced shear, the pipes are prestressed. Each pipe is prestressed in amounts particular to that pipe, and therefore, the pipes each have different amounts of prestressing placed thereon.

Figure 12:
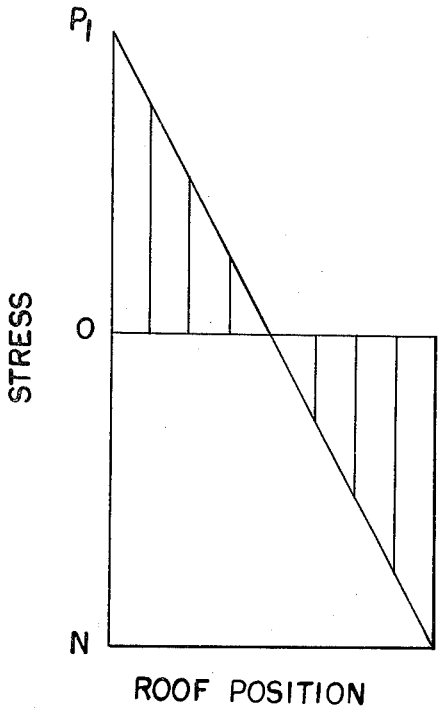
FIG. 12 is a stress diagram representing a stress pattern for an individual pipe of the drainage system of the present invention.
Figure 13:
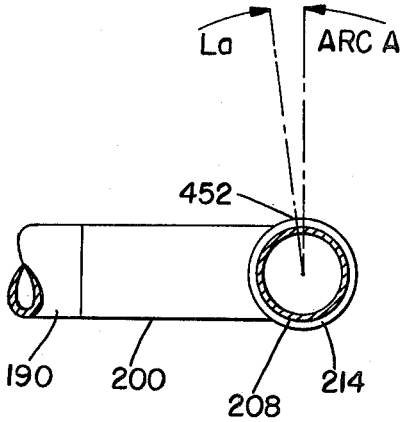
FIGS. 13-18 are views taken generally along lines 13—13, 14—14, 15—15, 16—16, 17—17 and 18—18 of FIG. 3 to indicate the angular relationship among the various elements of the drainage system of the invention.
Figure 14:
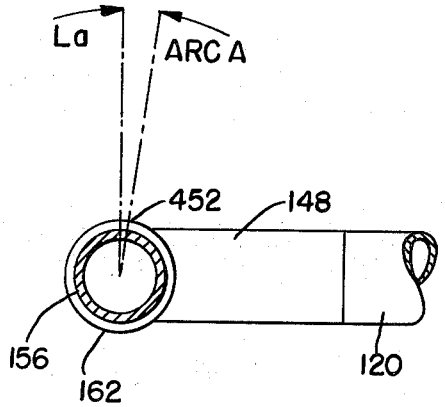

The pipe stressing for each pipe thus follows a pattern similar to that shown diagramatically in FIG. 12. The pipe represented in FIG. 12 thus has a maximum positive stress $P_1$ induced therein when in one of the end configurations of the system, that is, the drainage system is either in the fully deployed configuration with the roof on top of the product when the tank is full, or in the fully folded configuration when the bearing supports are flushly seated on the tank bottom, and then twists to and through a zero stress configuration and then into a maximum negative stress configuration N when the drainage system is in the other end configuration. The $P_1$ and N stress configurations are terms which refer to stress levels with respect to each other. Each pipe will follow a stress diagram particular thereto, but similar in form to the diagram shown in FIG. 12. Thus, each pipe is individually stressed and is positioned at an individual location with respect to the roof so that the pipes of the drainage system are sequentially moved and stressed.

The twisting of the pipes is indicated in FIGS. 13–16 and the following table indicates the amount of twist in the preferred embodiment.

| TANK | L | ANGLE - ARC | | | | | | DIMENSIONS | | |
|---|---|---|---|---|---|---|---|---|---|---|
| HEIGHT | DIM. | a° | A | b° | B | c° | C | D | E | F |
| | | | 5 | | 21 | | 9 | | | |
| 32'-0" | 36'-0" | 6¾ | 16 | 13½ | 32 | 5¾ | 32 | 4'-2 | 12'-4 | 20'-9 |
| | | | 3 | | 23 | | 5 | | | |
| 40'-0" | 40'-0" | 7½ | 8 | 15 | 32 | 5½ | 16 | 5'-2 | 15'-3 | 25'-7 |
| | | | 13 | | 25 | | 11 | | | |
| 48'-0" | 44'-0" | 8¼ | 32 | 16½ | 32 | 7¼ | 32 | 6'-3 | 18'-5 | 30'-11 |
| | | | 13 | | 27 | | 3 | | | |
| 56'-0" | 47'-0" | 8¾ | 32 | 17½ | 32 | 7¾ | 8 | 7'-0 | 20'-10 | 35'-0 |
| | | | 15 | | 29 | | 13 | | | |
| 64'-0" | 51'-0" | 9½ | 32 | 19 | 32 | 8½ | 32 | 8'-3 | 24'-7 | 41'-2 |

The dimensions D, E and F refer to the length of chain connectors 100, 130 and 166 respectively. It is noted that all of the arc dimensions for angles a, b and c are figured on the outside of a coupling having a radius of 2¾ inches. Preferably, the punch marks are located on the pipes so that during installation, the punch marks can be aligned to properly pre-torque the assembly.

Figure 8:
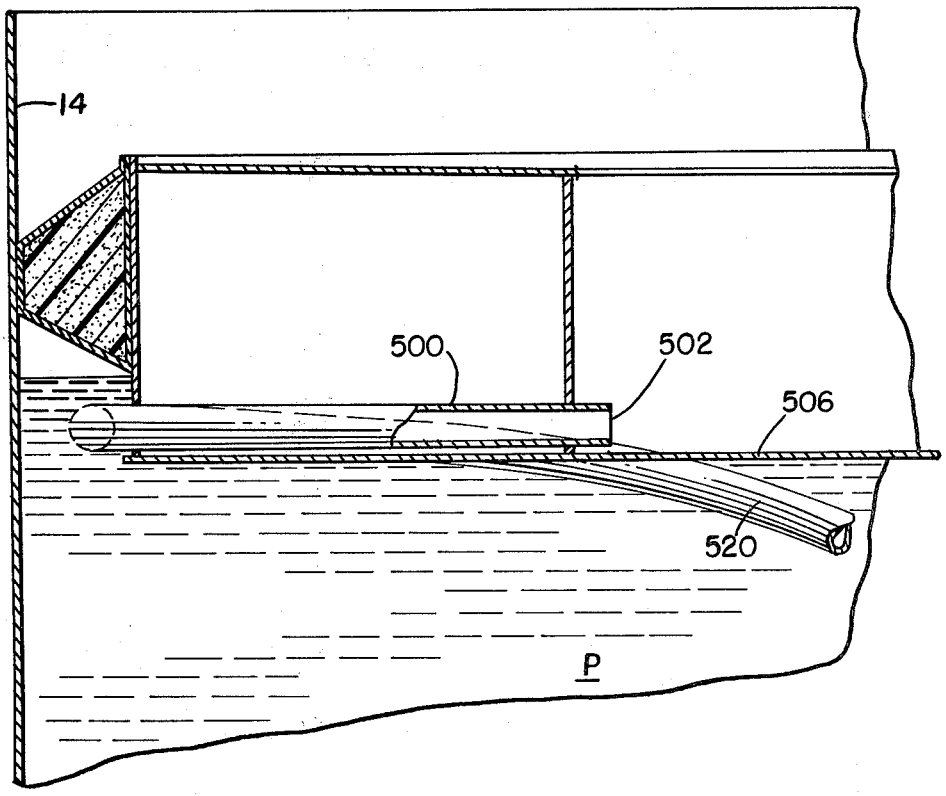
FIG. 8 is an elevation view of a portion of the floating roof incorporating the alternative form of the drainage system of the present invention.

Shown in FIGS. 6, 7 and 8 in an alternative embodiment of the present invention. In the alternative embodiment, the drainage system 30' includes a plurality of curved pipes which spiral downwardly from the floating roof 16 to the drain 34 when the drainage system is in the unfolded configuration. The drainage system 30' has an inlet pipe 500 having the inlet end 502 thereof located near the upper surface 504 of the deck 506 of the floating roof. The inlet 502 is the water collection means of the alternative embodiment and is shown in FIG. 6 to be located at or near the center of the roof, but can be located at other suitable positions on the roof, such as at or near the outer perimeter of that roof. The pipe 500 extends radially of the cylindrical tank and is attached at one end 510 to a first section 512 of curved pipe by a welded sleeve 514. The drainage system 30' further includes curved pipes 520 and 522 coupled together by welded sleeves 530 and 532, respectively, with coupling 530 coupling pipe 520 to pipe 512. A further coupling, coupling 540, connects pipe section 522 to outlet pipe 542 which connects the drainage system to a drain system 550.

As shown in FIG. 6, the pipes in the unfolded configuration are curved in two planes, a horizontal plane and a vertical plane so that the downward spiral configuration is produced. However, each pipe has only a single radius of curvature and the twisting thereof during movement of the roof creates this two-planar curvature.

The couplings 514, 530, 532 and 540 are welded in a manner similar to the couplings on the first embodiment of the invention.

As shown in FIG. 6, chain supports 560, 566 and 570 attach pipe sections 520 and 522 to the rimplate of the pontoon just below the seal 568 to permit the complete setting of the floating roof on the tank bottom. The rimplate is shown schematically in FIG. 6 and is indicated by the reference numeral 569. As in the first embodiment, the chain supports are of different lengths varying from the length of chain support 560, which is the shortest, to the length of chain support 570, which is the longest.

As in the first embodiment, the pipes of drainage system 30' are prestressed and are folded and unfolded sequentially. However, it is noted that the drainage system 30' does not include bearing supports similar to supports 250 of the first embodiment. As shown in FIG. 8, the drain system passes through a side wall of the floating roof rather than into a sump, and the roof deck is positioned at or near the bottom of pontoons 18' of the roof. Thus, the spiralling drain system 30' will rest on the tank bottom rather than on bearing supports when the roof is in a low position. However, even though the pipes rest on the tank bottom, these pipes are "folded" and "unfolded" sequentially as above discussed with reference to the first embodiment, and are individually prestressed as in the first embodiment.

Figure 19:
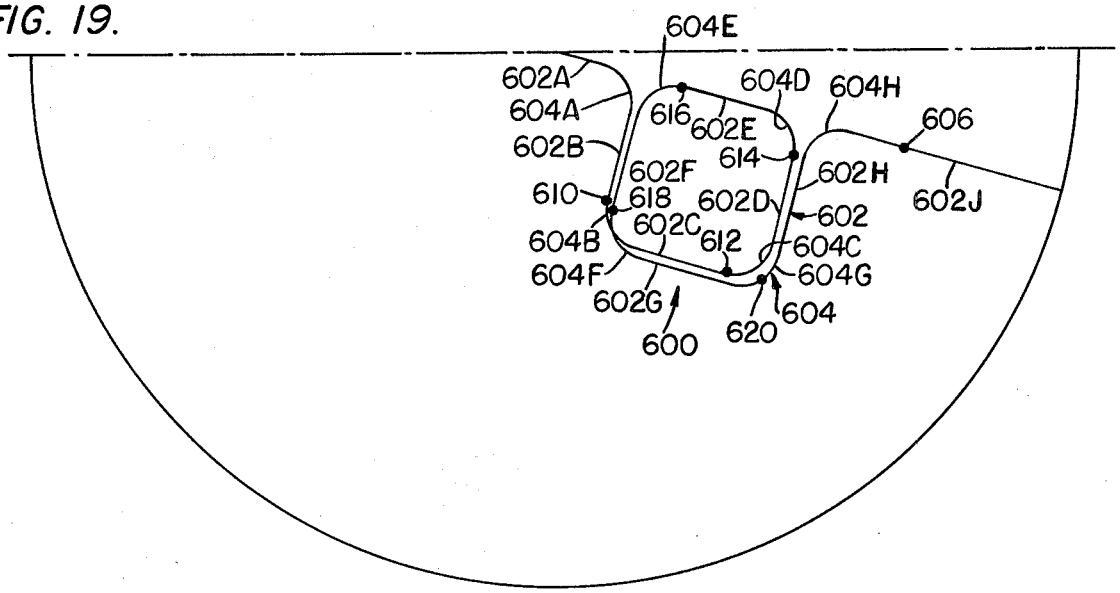
FIG. 19 is a plan view of a drainage system having a rectangular configuration.

An embodiment of the roof drainage system incorporating straight and bent pipe segments and which is in the form of a rectangle or a square is shown in FIG. 19, and indicated by reference numeral 600. As shown in FIG. 19, the drainage system 600 includes a plurality of straight pipe segments 602 and a plurality of curved pipe segments 604. The drainage system is connected to the sump 22 of the floating roof and to the tank, and rests on a plurality of supports, or legs 606. The leg supports 606 are similar to that bearing support shown in FIG. 10. The legs 606 can be numbered and placed as above discussed with regard to the FIG. 1 embodiment of the drainage system. It is noted that leg supports 606, like the FIG. 10 support, allow the pipe, such as pipe 602H, to rotate within the bearing, such as bearing 216A of FIG. 10, but do not permit any movement of the pipe in a vertical or a horizontal direction. The bearing does allow the pipe, such as the pipe 602H, to move in a direction parallel with the axis of that pipe. The drainage system 600 is shown schematically only, as the details are similar to those details already discussed.

The system 600 is similar to the system 30, and thus includes a hanger suspending a first horizontal pipe 602A from the bottom of the floating roof, and the pipe connections include welded couplings. The curved pipes can be ells if so desired. Thus, the system shown in FIG. 19 includes a first horizontal pipe 602A connected at one end thereof to the sump 22, and supported on the bottom of the floating roof, inclinable pipes 602B through 602H each weldably connected at the ends thereof to ells 604A through 604H inclusively. The system also includes a second horizontal pipe 602J weldably connected at one end thereof to ell 604H and at the other end thereof to a tank drain valve.

Figure 20:
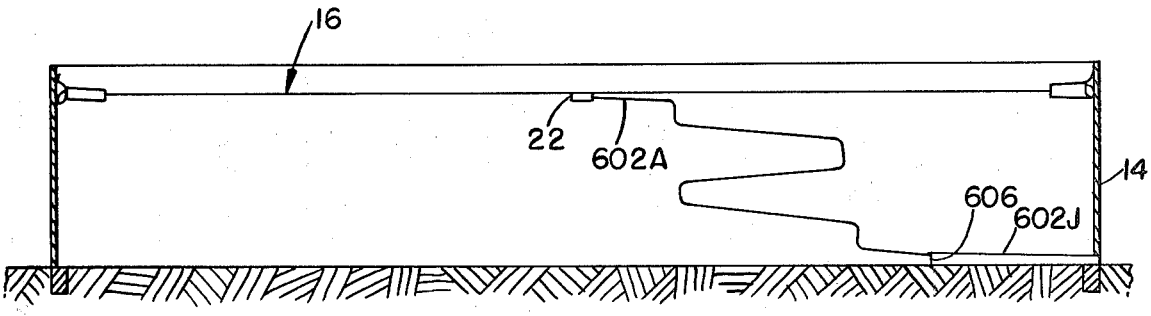
FIGS. 20 and 21 are elevation views of the FIG. 19 drainage system in the tank-full and tank-empty orientations.
Figure 21:
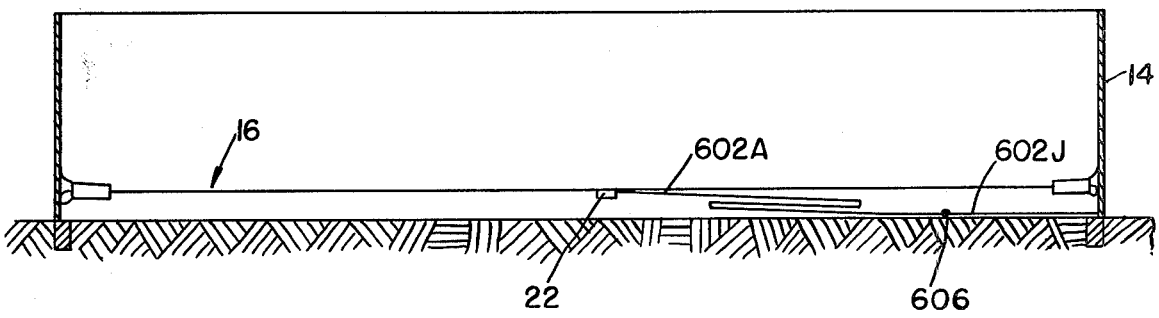

The floating roof is shown in the tank-full condition in FIG. 20, and the tank-empty condition in FIG. 21, and thus the FIGS. 20 and 21 show a complete stroke. Stroke is herein defined as the vertical movement of the roof from the tank-empty to the tank-full condition. It is here noted that the roof rests on legs in the tank-empty condition, and as the roof does not reach the exact upper end of the tank, stroke is less than the tank height.

As shown in FIG. 19, a plurality of chains, 610 through 620 inclusively, are included in the drainage system 600. The chains are not shown in FIG. 20 in the interest of clarity. The chains are attached to the floating roof and to the pipe loop. The lengths of the chains are presented in the following table:

| Chain | Length |
|---|---|
| 610 | 5'-8" |
| 612 | 12'-1" |
| 614 | 18'-2" |
| 616 | 24'-4" |
| 618 | 30'-8" |
| 620 | 37'-9" |

Figure 22:
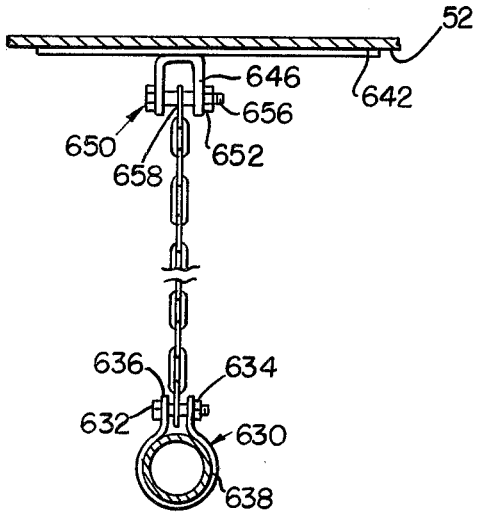
FIG. 22 is an elevation view of a chain connector used in the FIG. 19 embodiment.
Figure 23:
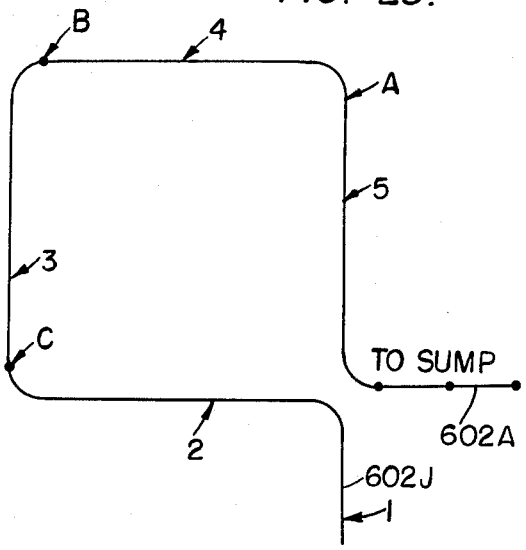
FIGS. 23-30 are plan views of various tank height drainage system configurations.
Figure 24:
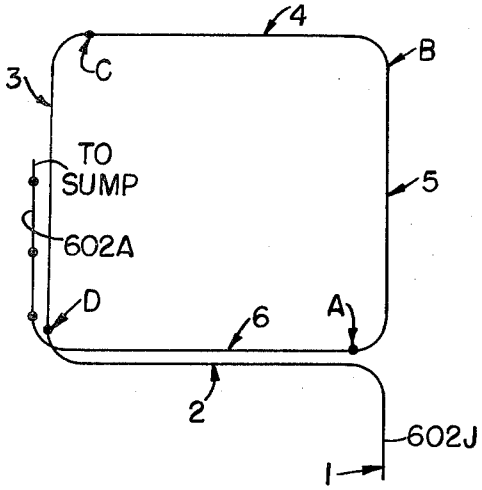
Figure 25:
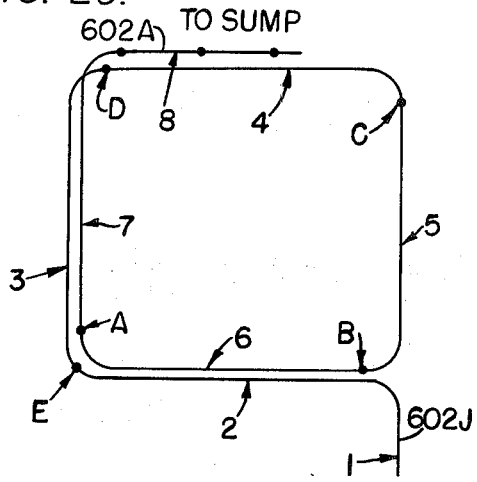
Figure 26:
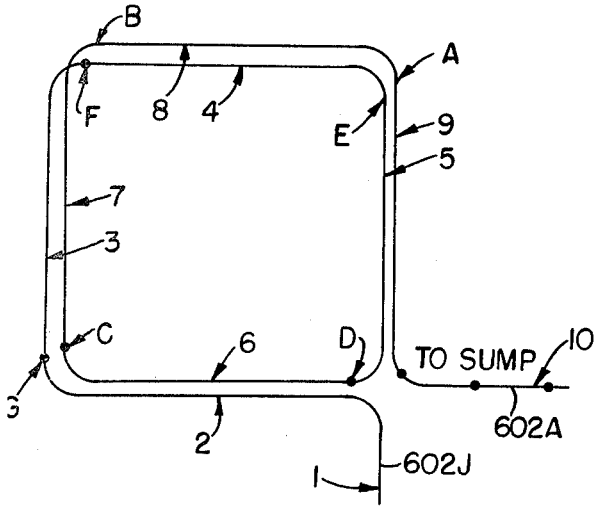
Figure 27:
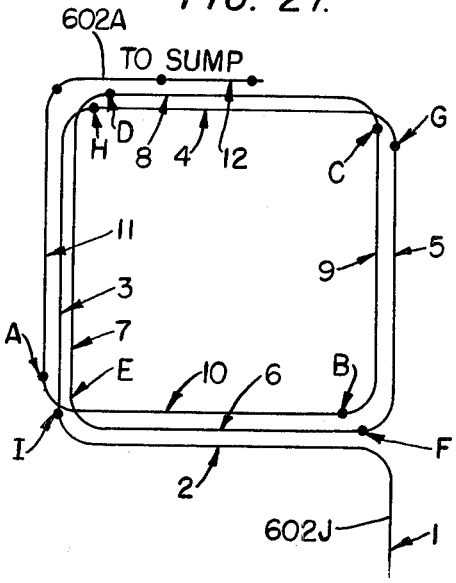

A chain attached to a roof is shown in FIG. 22. The chain is attached to a pipe by a clamp 630 which includes a fastener, such as bolt 632 and a nut 634 positioned in aligned holes defined in ears 636 located on opposite ends of looped body 638 of the clamp. The looped body is continuous around the bottom side of the pipe. It is noted that clamp 630 is a single bolted clamp. A double bolted clamp can also be used; however, a single bolted clamp is preferred, as a double bolted clamp may increase the possibility that a chain might snag on the lower bolt when the roof is in a low position. A snagged chain has a reduced effective length, and thus will be shorter than anticipated when the chain comes into play. As shown in FIG. 22, the chain is attached to the floating roof undersurface 52 by a mounting plate 642 on which a U-bracket 646 is mounted. A support bolt 650 is attached to the bracket 646, as by a nut 652 threaded onto a threaded end 656 of the bolt. One link 658 of the chain can be connected to the bolt between the legs of the U-bracket to be supported on the roof.

It is also noted by comparing FIGS. 1 and 2 with FIG. 22 that the drainage system 600 includes chains having a single length of chain as opposed to the double chains included in the drainage system 30, as shown in FIGS. 1 and 2. However, double chains can be used with the drainage system 600, or single chains can be used with the drainage system 30, if so desired, without departing from the scope of the present invention.

It is also noted that there are preferably seven drain supports included in drainage system 600. These seven drain supports are identical to the drain supports 250B shown in FIG. 1. These supports only come into play when the roof is in a low position (i.e., the FIG. 21 position), and some portion of the coiled pipe arrangement is sitting on the bottom of the tank and is in a relaxed mode.

FIGS. 23–27 show configurations for the drainage system 600 for various tank heights, and hence various strokes. The following tables present pertinent dimensions for those configurations. It is noted that "radius of curvature" refers to the curved pipe 604. It is also noted that the tables are set up according to pipe diameter and wall thickness.

| | | | 3" × 0.216 WALL | | | | | | | | | | | | |
|---|---|---|---|---|---|---|---|---|---|---|---|---|---|---|---|
| | Tank | | PIPE LENGTH | | | | | | | | | | | | |
| FIG. | Height | Stroke | 1 | 2 | 3 | 4 | 5 | 6 | 7 | 8 | 9 | 10 | 11 | 12 | 13 |
| 24 | 32'-0 | 28'-0 | 23' | 46' | 46' | 46' | 44' | 48' | 23' | — | — | — | — | — | — |
| 25 | 40'-0 | 36'-0 | 23' | 46' | 46' | 46' | 44' | 44' | 46' | 46' | — | — | — | — | — |
| 28 | 48'-0 | 44'-0 | 23' | 46' | 46' | 46' | 44' | 44' | 46' | 46' | 23' | — | — | — | — |
| 29 | 56'-0 | 52'-0 | 23' | 46' | 46' | 46' | 44' | 44' | 46' | 46' | 44' | 46' | 23' | — | — |
| 30 | 64'-0 | 64'-0 | 23' | 46' | 46' | 46' | 44' | 44' | 46' | 46' | 44' | 46' | 46' | 46' | 23' |

| | CHAIN LENGTH | | | | | | | | | | Rad. of | Total | Total |
|---|---|---|---|---|---|---|---|---|---|---|---|---|---|
| FIG. | A | B | C | D | E | F | G | H | I | J | Curv. | Length | Wgt. |
| 24 | 5'-5 | 10'-9 | 16'-4 | 22'-0 | — | — | — | — | — | — | 3.5' | 276'-0 | 2089.32 |
| 25 | 5'-8 | 11'-5 | 17'-3 | 23'-4 | 29'-5 | — | — | — | — | — | 3.5' | 318'-0 | 2407.26 |
| 28 | 6'-2 | 12'-1 | 18'-2 | 24'-4 | 30'-8 | 37'-1 | — | — | — | — | 3.5' | 362'-0 | 2740.34 |
| 29 | 5'-7 | 11'-7 | 16'-6 | 22'-6 | 28'-1 | 33'-9 | 39'-8 | 45'-8 | — | — | 3.5' | 450'-0 | 3406.5 |
| 30 | 5'-2 | 10'-8 | 17'-1 | 21'-7 | 26 40 -8 | 32'-3 | 37'-7 | 42'-11 | 48'-5 | 54'-0 | 3.5' | 542'-0 | 4102.94 |

| | | | 4" × .0237 WALL | | | | | | | | | | | |
|---|---|---|---|---|---|---|---|---|---|---|---|---|---|---|
| | Tank | | PIPE LENGTH | | | | | | | | | | | |
| FIG. | Height | Stroke | 1 | 2 | 3 | 4 | 5 | 6 | 7 | 8 | 9 | 10 | 11 | 12 |
| 23 | 32'-0 | 28'-0 | 27' | 54' | 54' | 54' | 52' | 27' | — | — | — | — | — | — |
| 24 | 40'-0 | 36'-0 | 27' | 54' | 54' | 54' | 52' | 56' | 27' | — | — | — | — | — |
| 25 | 48'-0 | 44'-0 | 27' | 54' | 54' | 54' | 52' | 52' | 54' | 27' | — | — | — | — |
| 26 | 56'-0 | 52'-0 | 27' | 54' | 54' | 54' | 52' | 52' | 54' | 54' | 54' | 27' | — | — |
| 27 | 64'-0 | 60'-0 | 27' | 54' | 54' | 54' | 52' | 52' | 54' | 50' | 52' | 54' | 54' | 27' |

| | CHAIN LENGTH | | | | | | | | | Rad. of | Total | Total |
|---|---|---|---|---|---|---|---|---|---|---|---|---|
| FIG. | A | B | C | D | E | F | G | H | I | Curv. | Length | Wgt. |
| 23 | 6'-3 | 13'-3 | 20'-4 | — | — | — | — | — | — | 4.5' | 268'-0 | 2891.72 |
| 24 | 6'-10 | 13'-11 | 21'-0 | 28'-2 | — | — | — | — | — | 4.5' | 324'-0 | 3499.96 |
| 25 | 7'-5 | 13'-11 | 21'-1 | 28'-6 | 36'-8 | — | — | — | — | 4.5' | 374'-0 | 4035.46 |
| 26 | 6'-6 | 12'-7 | 19'-2 | 25'-5 | 31'-9 | 38'-4 | 44'-11 | — | — | 4.5' | 482'-0 | 5200.78 |
| 27 | 5'-7 | 11'-9 | 17'-10 | 23'-3 | 29'-5 | 35'-3 | 41'-2 | 47'-3 | 53'-5 | 4.5' | 584'-0 | 6301.36 |

| | | | 6" × 0.280 WALL | | | | | | | | | | | |
|---|---|---|---|---|---|---|---|---|---|---|---|---|---|---|
| | Tank | | PIPE LENGTH | | | | | | | | | | | |
| FIG. | Height | Stroke | 1 | 2 | 3 | 4 | 5 | 6 | 7 | 8 | 9 | 10 | 11 | 12 |
| 23 | 32'-0 | 28'-0 | 33' | 66' | 66' | 66' | 64' | 33' | — | — | — | — | — | — |
| 24 | 40'-0 | 36'-0 | 33' | 66' | 66' | 66' | 64' | 68' | 33' | — | — | — | — | — |
| 25 | 48'-0 | 44'-0 | 33' | 66' | 66' | 66' | 64' | 64' | 66' | 33' | — | — | — | — |
| 26 | 56'-0 | 52'-0 | 33' | 66' | 66' | 66' | 64' | 64' | 66' | 66' | 66' | 33' | — | — |
| 27 | 64'-0 | 60'-0 | 33' | 66' | 66' | 66' | 64' | 64' | 66' | 62' | 64' | 66' | 66' | 33' |

| | CHAIN LENGTH | | | | | | | | | Rad. of | Total | Total |
|---|---|---|---|---|---|---|---|---|---|---|---|---|
| FIG. | A | B | C | D | E | F | G | H | I | Curv. | Length | Wgt. |
| 23 | 5'-9 | 12'-10 | 19'-11 | — | — | — | — | — | — | 10.0' | 328'-0 | 6222.16 |
| 24 | 6'-4 | 13'-4 | 20'-6 | 27'-9 | — | — | — | — | — | 10.0' | 396'-0 | 7512.12 |
| 25 | 6'-3 | 13'-6 | 21'-10 | 28'-1 | 36'-10 | — | — | — | — | 10.0' | 458'-0 | 8688.20 |
| 26 | 5'-7 | 12'-1 | 18'-8 | 25'-0 | 31'-4 | 37'-11 | 44'-5 | — | — | 10.0' | 590'-0 | 11192.3 |

-continued

| FIG. | CHAIN LENGTH A | B | C | D | E | F | G | H | I | Rad. of Curv. | Total Length | Total Wgt. |
|---|---|---|---|---|---|---|---|---|---|---|---|---|
| 27 | 5'-2 | 11'-3 | 17'-2 | 22'-11 | 29'-0 | 34'-11 | 40'-10 | 49'-11 | 53'-0 | 10.0' | 716'-0 | 13582.52 |

As a matter of design, it is noted that the lengths given in the tables are based upon the vertical distance required, and were measured from the centerline of the straight pipe connected to the sump 22. As the straight pipe is nine inches below the level of the floating roof, a correction of nine inches is required. Therefore, the table lengths should be increased by nine inches. The numbers and letters in the tables refer to the numbers and letters noted in FIGS. 23–30 inclusively.

Referring to the above tables, the dimensions for a three inch pipe can be compared to the dimensions for other pipes. The three inch table gives the different dimensions of the individual pipe lengths, chain lengths, and the like for each tank height or stroke. Comparing FIGS. 28–30 with FIGS. 23–27 (which has a 44 foot stroke), FIG. 28 becomes the pertinent figure. The different pipe lengths are then given on the third line (i.e., for FIG. 28) of the three inch diameter table, as are the radii of curvature of the corners, and chain lengths.

Figure 28:
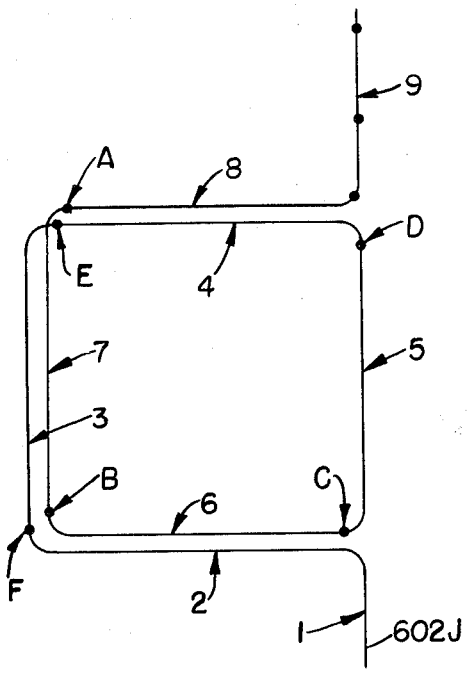
Figure 29:
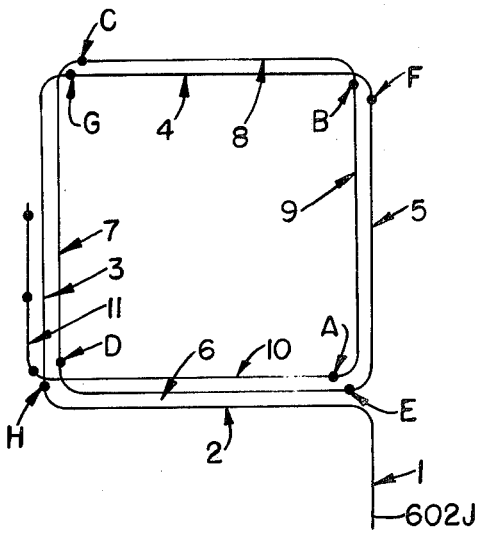
Figure 30:
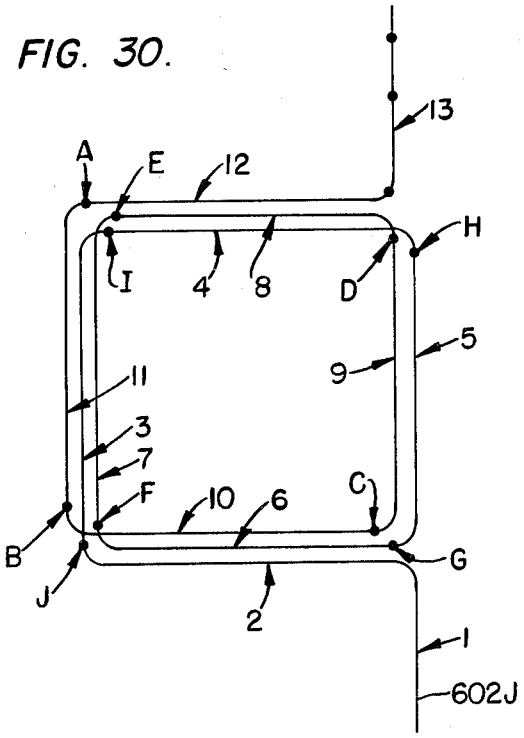

As can be seen from FIGS. 28–30, if one had a different tank height but still required a three inch diameter drain, one would change the looping arrangement. FIG. 29 would be used for a 52 foot tank height, as an example.

The sump used in system 600 corresponds to that sump used in system 30, as is the penetration through the tank wall. Other details are also similar in the two systems. Any joints in the loop, as where straight pipes join elbows, or other curved pipes, are effected by welding and utilize the same methods of joining as shown in FIG. 3, with the exception that the prestressing angles are no longer pertinent.

It is also noted that a 44 foot stroke having a four inch diameter pipe would include chain lengths of: chain 612—7'5"; chain 614—13'11"; chain 616—21'1"; chain 620—36'8"; and an additional chain connected to the lower loop adjacent the location shown in FIG. 19 for chain 610 of 28'6".

The following is a list of essentials for the drainage system 600:

1. The size of square formed by the piping. This varies with the diameter of the pipe.
2. The radius of the corner pipes. This varies with the diameter of the pipe.
3. The amount of looping or the number of loops of the square pattern. This varies with the vertical movement or tank height.
4. The location and length of chain or cable. This is determined by calculation of the allowed maximum stress.
5. Selection of the grade of pipe material. This determines allowable stress.

Referring to this list of essentials, one would start with the given required draining capacity. This would set the diameter of the pipe to be used. Larger tanks or tropical areas would, of course, require large diameter pipes. Once the pipe size has been selected, the size of the square formed by the piping is set as the radius of the corner pipes. Also, one would know at this time the height of the tank and therefore the stroke of the floating roof. This would then set the amount of looping, or the number of loops of the square pattern. The chains are located near the corner pipes of the lengths and positions are selected so as to control the amount of stress in the pipe loops to acceptable levels depending upon the grade of pipe material selected. The grade selected determines the allowable stress in the loop pipe.

A preferred tank size is 280 feet in diameter, but using the above discussion, many variations can be found. Some variations which are possible are as follows:

1. More than one drain might be used per tank, i.e., two 3" pipes.
2. Cable instead of chain.
3. Floats could be added to the chains to make them buoyant and thereby lift them off the bottom of the tank.
4. Rectangular configurations rather than square configurations. Other configurations such as hexagonal or other shapes approaching a circular shape can also be used. In fact, a circle is even possible.
5. Tubing can be used in place of pipe. The tubing can be square or rectangular. Various metals, i.e., steel or aluminum can be used. Reinforced plastic with adhesively welded joints, for example, glass reinforced polyester resin piping can also be used.
6. Sump 22 could be located other than at tank centerline.
7. Supports could be affixed to the bottom rather than fastened to the loop.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A floating roof drainage system comprising:

a roof drain means on the floating roof;

a plurality of pipes including a first pipe connected to said drain means and a second pipe connected to another pipe connected to a drain on a tank associated with the floating roof;

a plurality of rigid pipe connections connecting individual pipes of said plurality of pipes to the next adjacent ones of said plurality of pipes, said connections being welded to said connected pipes to produce a welded connection between said connected pipes, said plurality of pipes being arranged to form a loop, said welded connections making said loop rigid and essentially continuous from said roof drain means to a tank drain whereby leakage in a floating roof drainage system is minimized;

said individual pipes each being prestressed to a predetermined degree; and connecting means connecting selected pipes of said plurality of pipes to the floating roof.

2. The floating roof drainage system of claim 1 wherein said roof drain means includes a sump and a one-way valve.

3. The floating roof drainage system of claim 1 wherein said first and second pipes are radially directed with regard to a circular tank and are maintained in a horizontal orientation during movement of the floating roof.

4. The floating roof drainage system of claim 1 wherein said plurality of pipes includes a plurality of inclined pipes.

5. The floating roof drainage system of claim 4 wherein said inclined pipes are sequentially moved as the floating roof moves.

6. The floating roof drainage system of claim 4 wherein said plurality of pipes includes a plurality of ells.

7. The floating roof drainage system of claim 1 wherein said connecting means includes a pair of chains suspending said selected pipes from said floating roof.

8. The floating roof drainage system of claim 7 including three pairs of chains, each pair having a length different from the other pairs of chains.

9. The floating roof drainage system of claim 7 wherein each pair of chains is connected to the floating rood and to a pipe to form a triangular configuration with the apex of the triangular configuration located adjacent said pipe.

10. The floating roof drainage system of claim 9 wherein said chains include coil chains.

11. The floating roof drainage system of claim 1 further including a hanger suspending said first pipe from the bottom of the floating roof.

12. The floating roof drainage system of claim 11 further including a plurality of bearing supports for supporting said pipes on the bottom of a tank.

13. The floating roof drainage system of claim 12 wherein selected ones of said bearing supports include sleeves slidably receiving therethrough one of said pipe connections.

14. The floating roof drainage system of claim 13 wherein said hanger support includes a sleeve slidably receiving therethrough said first pipe.

15. The floating roof drainage system of claim 1 wherein said predetermined degree of prestressing is selected so that said individual pipes are sequentially stressed from the level of said prestressing to a value which is the negative of said prestressing level.

16. The floating roof drainage system of claim 1 wherein said pipe connections include welded couplings.

17. The floating roof drainage system of claim 1 wherein said plurality of pipes includes a first horizontal pipe connected at one end thereof to said drain means and which is suspended from the bottom of said floating roof, a first ell weldably connected at one end thereof to another end of said first pipe, a first inclined pipe weldably connected at one end thereof to another end of said first ell, a second ell weldably connected at one end thereof to another end of said first inclined pipe, a second inclined pipe weldably connected at one end thereof to another end of said second ell, a third ell weldably connected at one end thereof to another end of said second inclined pipe, a third inclined pipe weldably connected at one end thereof to another end of said third ell, a fourth ell weldably connected at one end thereof to another end of said third inclined pipe, a fourth inclined pipe weldably connected at one end thereof to another end of said fourth ell, a fifth ell weldably connected at one end thereof to another end of said fourth inclined pipe, a fifth inclined pipe weldably connected at one end thereof to another end of said fifth ell, a sixth ell weldably connected at one end thereof to another end of said fifth inclined pipe, and a second horizontal pipe connected at one end thereof to another end of said sixth ell, and at the other end thereof to the tank drain valve.

18. The floating roof drainage system of claim 17 wherein said selected pipes include said second, third and fourth inclined pipes with the connecting means on said third inclined pipe being longer than the connecting means on said second inclined pipe and shorter than the connecting means on said fourth inclined pipe.

19. The floating roof drainage system of claim 17 further including a bearing support on said first, second, third and fourth inclined pipes.

20. The floating roof drainage system of claim 1 wherein said pipes are all curved.

21. The floating roof drainage system of claim 20 wherein said first pipe is located on top of a deck of the floating roof and has one end thereof forming said drain means and extends through a wall of the floating roof.

22. The floating roof drainage system of claim 21 wherein said first pipe one end is located near the center of the floating roof.

23. The floating roof of claim 1 wherein said connecting means are attached to the bottom of the floating roof.

24. The floating roof of claim 1 wherein said connecting means include a plurality of chains each attached at one end thereof to a rimplate on said floating roof.

25. A floating roof drainage system comprising:

a roof drain means on the floating roof;

a plurality of pipes including a first pipe connected to said drain means and a second pipe connected to another pipe connected to a drain on a tank associated with the floating roof;

a plurality of rigid pipe connections connecting individual pipes of said plurality of pipes to the next adjacent ones of said plurality of pipes, said connections being welded to said connected pipes to produce a welded connection between said connected pipes, said plurality of pipes being arranged to form a loop, said welded connections making said loop rigid and essentially continuous from said roof drain means to a tank drain whereby leakage in a floating roof drainage system is minimized; and connecting means connecting selected pipes of said plurality of pipes to the floating roof.

26. The floating roof drainage system of claim 25 wherein said roof drain means includes a sump and a one-way valve.

27. The floating roof drainage system of claim 25 wherein said first and second pipes are radially directed with regard to a circular tank and are maintained in a horizontal orientation during movement of the floating roof.

28. The floating roof drainage system of claim 25 wherein said plurality of pipes includes a plurality of inclinable pipes.

29. The floating roof drainage system of claim 28 wherein said inclined pipes are sequentially moved as the floating roof moves.

30. The floating roof drainage system of claim 28 wherein said plurality of pipes includes a plurality of ells.

31. The floating roof drainage system of claim 25 wherein said connecting means includes chains suspending said selected pipes from said floating roof.

32. The floating roof drainage system of claim 31 including three chains, each having a length different from the other chains.

33. The floating roof drainage system of claim 25 further including a hanger suspending said first pipe from the bottom of the floating roof.

34. The floating roof drainage system of claim 33 further including a plurality of bearing supports for supporting said pipes on the bottom of a tank.

35. The floating roof drainage system of claim 34 wherein selected ones of said bearing supports include sleeves slidably receiving therethrough one of said pipe connections.

36. The floating roof drainage system of claim 35 wherein said hanger support includes a sleeve slidably receiving therethrough said first pipe.

37. The floating roof drainage system of claim 25 wherein said pipe connections include welded couplings.

38. The floating roof drainage system of claim 25 wherein said plurality of pipes includes a first horizontal pipe connected at one end thereof to said drain means and which is suspended from the bottom of said floating roof, a first ell weldably connected at one end thereof to another end of said first pipe, a first inclinable pipe weldably connected at one end thereof to another end of said first ell, a second ell weldably connected at one end thereof to another end of said first inclinable pipe, a second inclinable pipe weldably connected at one end thereof to another end of said second ell, a third ell weldably connected at one end thereof to another end of said second inclinable pipe, a third inclinable pipe weldably connected at one end thereof to another end of said third ell, a fourth ell weldably connected at one end thereof to another end of said third inclinable pipe, a fourth inclinable pipe weldably connected at one end thereof to another end of said fourth ell, a fifth ell weldably connected at one end thereof to another end of said fourth inclinable pipe, a fifth inclinable pipe weldably connected at one end thereof to another end of said fifth ell, a sixth ell weldably connected at one end thereof to another end of said fifth inclinable pipe, a sixth inclinable pipe weldably connected at one end thereof to antoher end of said sixth ell, a seventh ell weldably connected at one end thereof to another end of said sixth inclinable pipe, a seventh inclinable pipe weldably coupled at one end thereof to another end of said seventh ell, an eighth ell weldably connected at one end to another end of said seventh inclinable pipe, and a second horizontal pipe connected at one end thereof to another end of said eighth ell, and at the other end thereof to the tank drain valve.

39. The floating roof drainage system of claim 38 wherein said selected pipes include said first, second, third and fourth inclinable pipes.

* * * * *